US005379715A

United States Patent [19]

Skaarup et al.

[11] Patent Number: 5,379,715

[45] Date of Patent: Jan. 10, 1995

[54] SYSTEM FOR LAUNCHING BARGES FROM SHIPS

[75] Inventors: Ole Skaarup, Greenwich; James H. Hara, Ridgefield, both of Conn.

[73] Assignee: Skarhar, Inc., Greenwich, Conn.

[21] Appl. No.: 974,260

[22] Filed: Nov. 10, 1992

[51] Int. Cl.[6] ..... B63B 23/00

[52] U.S. Cl. ..... 114/375; 114/260

[58] Field of Search ..... 114/31–33, 114/26, 27, 201, 202, 220, 365, 366, 375, 258–260, 343, 344, 364, 121, 125

[56] References Cited

U.S. PATENT DOCUMENTS

| | | | |
|---|---|---|---|
| 631,066 | 8/1899 | Des-Fours | 114/375 |
| 1,064,472 | 6/1913 | Haas | 114/77 A |
| 1,076,068 | 10/1913 | Schleicher | 114/77 A |
| 1,087,858 | 2/1914 | Wickham | 114/375 |
| 1,198,439 | 9/1916 | Herfjord | 114/77 A |
| 1,270,903 | 7/1918 | Weismantel | 114/375 |
| 1,276,055 | 8/1918 | Groleau | 114/366 |
| 2,057,995 | 10/1936 | Badovici | 114/0.5 |
| 2,351,478 | 6/1944 | Boyle | 114/259 |
| 3,302,786 | 5/1962 | Hudson et al. | 9/41 |
| 3,303,945 | 2/1967 | Hubbard | 114/375 |
| 3,536,023 | 10/1970 | Toher et al. | 114/43.5 |
| 3,556,036 | 6/1971 | Wells | 114/43.5 |
| 3,776,167 | 12/1973 | Marbury | 114/259 |
| 4,083,319 | 4/1978 | Nishino et al. | 114/260 |

FOREIGN PATENT DOCUMENTS

| | | | |
|---|---|---|---|
| 86266 | 8/1955 | Norway | 114/375 |
| 1023983 | 3/1966 | United Kingdom . | |

*Primary Examiner*—Robert J. Oberleitner
*Assistant Examiner*—Clifford T. Bartz
*Attorney, Agent, or Firm*—John H. Crozier

[57] ABSTRACT

In a preferred embodiment, a system for launching barges from the deck of a ship, the system including: ramp means selectively positionable along the side of the ship such that a selected one of the barges may be placed on the ramp means and allowed to slide therealong by gravity into water in which the ship is floating.

10 Claims, 7 Drawing Sheets

SYSTEM FOR LAUNCHING BARGES FROM SHIPS

BACKGROUND OF THE INVENTION

1. Field of the Invention

The present invention relates to launchable barges generally and, more particularly, but not by way of limitation, to a novel system for launching barges from ships.

2. Background Art

There exists a need to have an improved system for launching barges from the main decks of ships. Especially in the military context, it is necessary to be able to rapidly launch cargo carrying barges from ships so that the barges can be self-propelled or towed to shore.

Accordingly, it is a principal object of the present invention to provide a system for the rapid launching of barges from the main decks of ships.

It is a further object of the invention to provide such a system that can be rapidly and easily deployed.

It is an additional object of the invention to provide such a system that can be economically retrofit to existing ships.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a system for launching barges from the deck of a ship, said system comprising: ramp means selectively positionable along the side of said ship such that a selected one of said barges may be placed on said ramp means and allowed to slide therealong by gravity into water in which said ship is floating.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
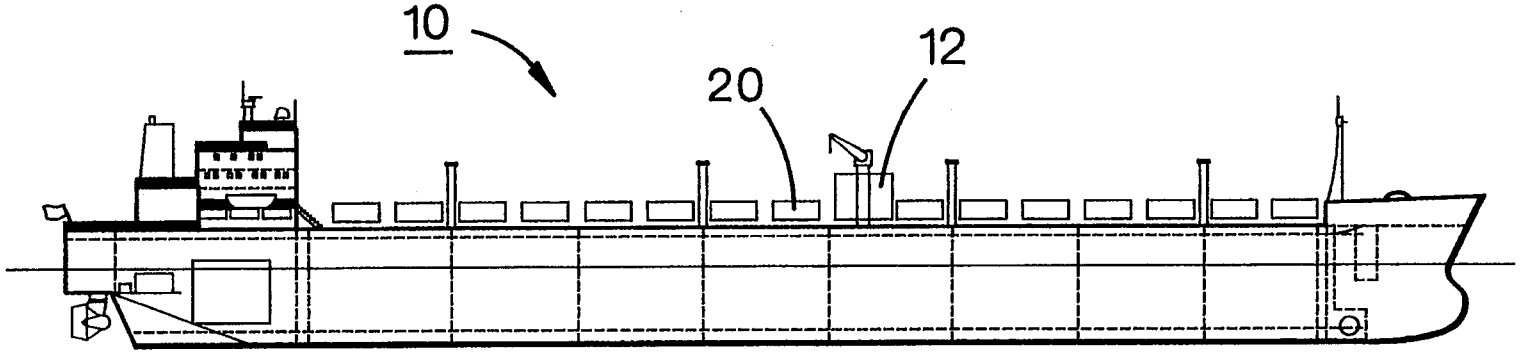
FIG. 1 is an side elevational view of a ship employing the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
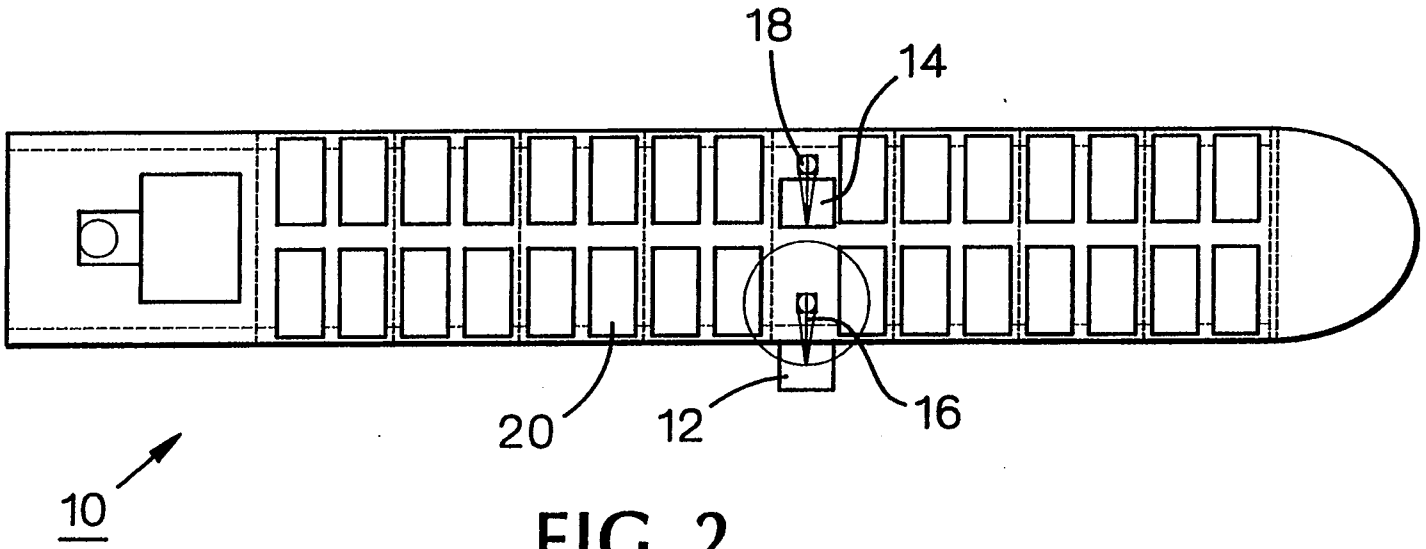
FIG. 2 is a top plan view of the ship of FIG. 1.

FIGS. 1 and 2 illustrate a ship, generally indicated by the reference numeral 10, employing a launching system according to the present invention. Ship 10 includes first and second launching structures 12 and 14, structure 12 and structure 14 being shown in stored position on FIGS. 1 and 2, respectively, and structure 12 being shown in deployed position on FIG. 2. Structures 12 and 14 are moved between their stored and deployed positions by means of cranes 16 and 18, respectively. A plurality of splash barges, as at 20, are shown disposed on the main deck of ship 10.

Figure 3:
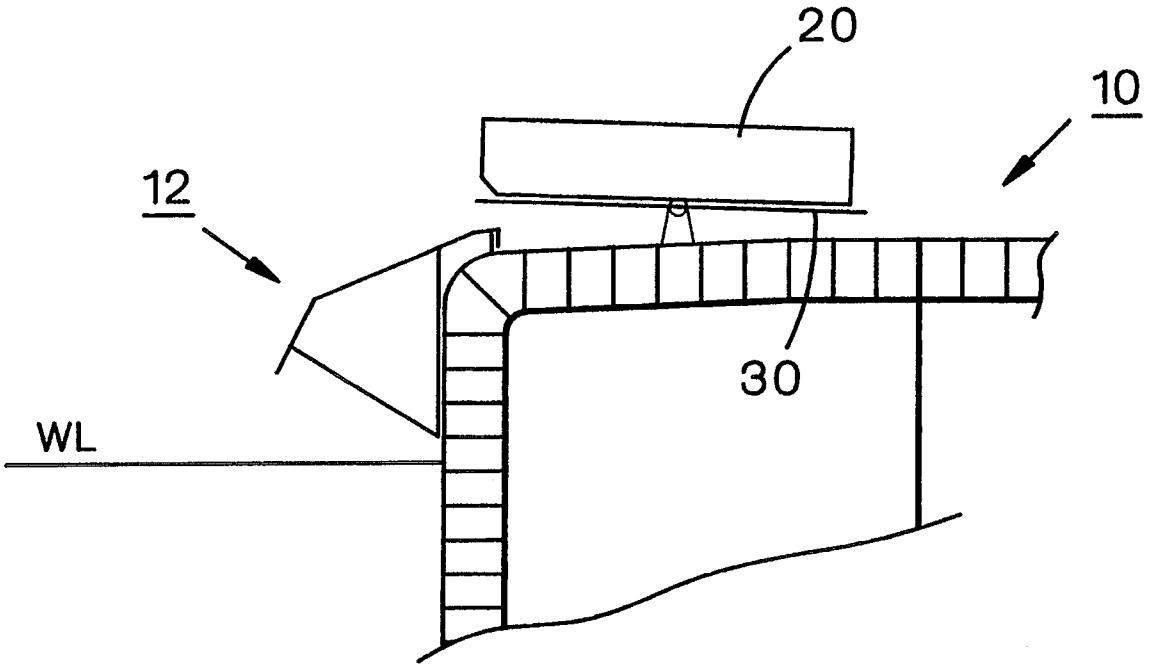
FIG. 3 is a fragmentary, schematic, end elevational view, partially in cross-section of the ship of FIG. 1, showing a splash barge in stored position on the main deck of the ship.

FIG. 3 schematically illustrates a splash barge 20 in stored position on a tilt platform 30 and launching structure 12 in deployed position. The inboard end of tilt platform 30 is preferably somewhat lower than the outboard end. Splash barge 20 is releasably secured to tilt platform by any suitable mechanical means.

Figure 4:
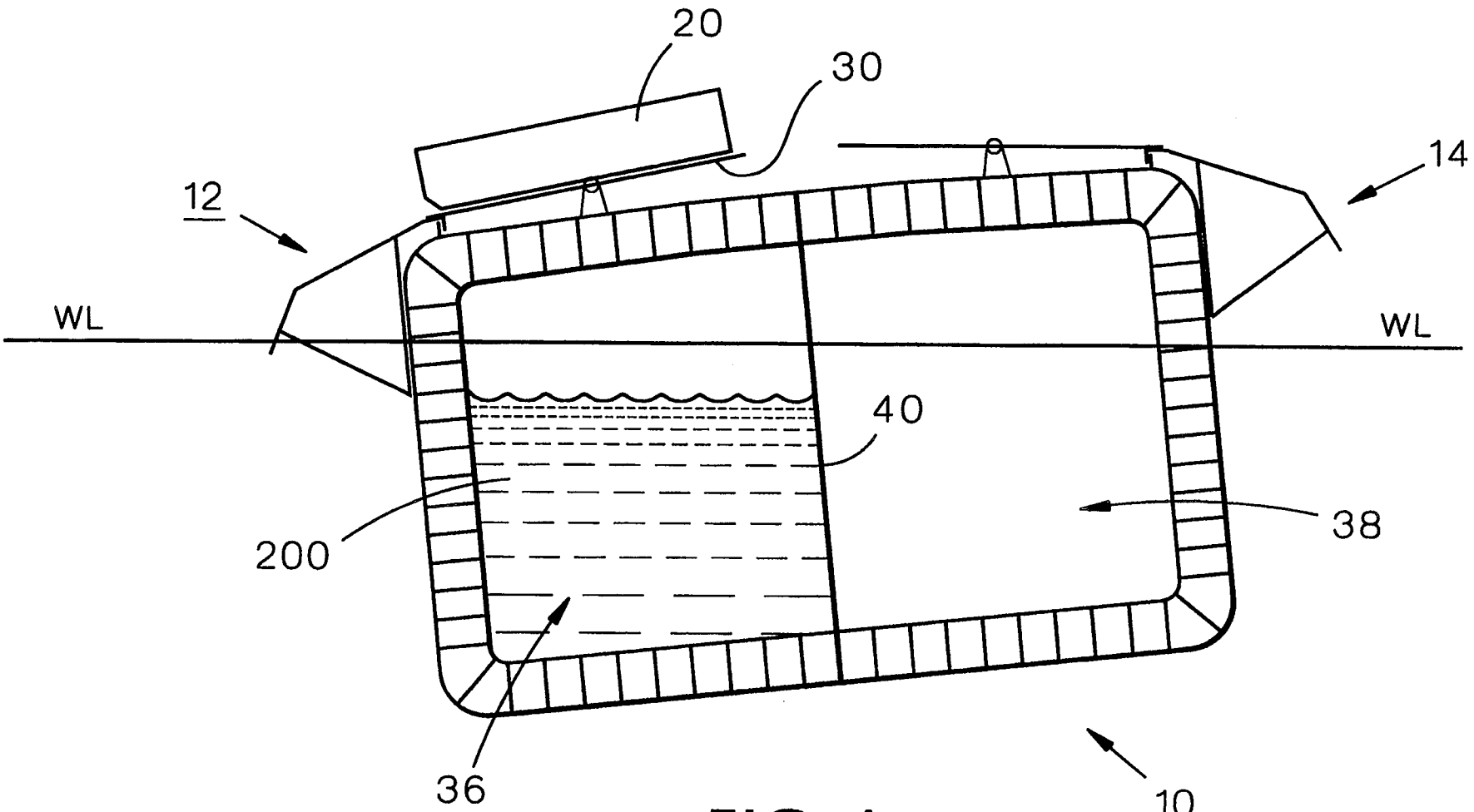
FIG. 4 is a schematic, end elevational view, partially in cross-section, of the first step in launching the splash barge of FIG. 3.
Figure 5:
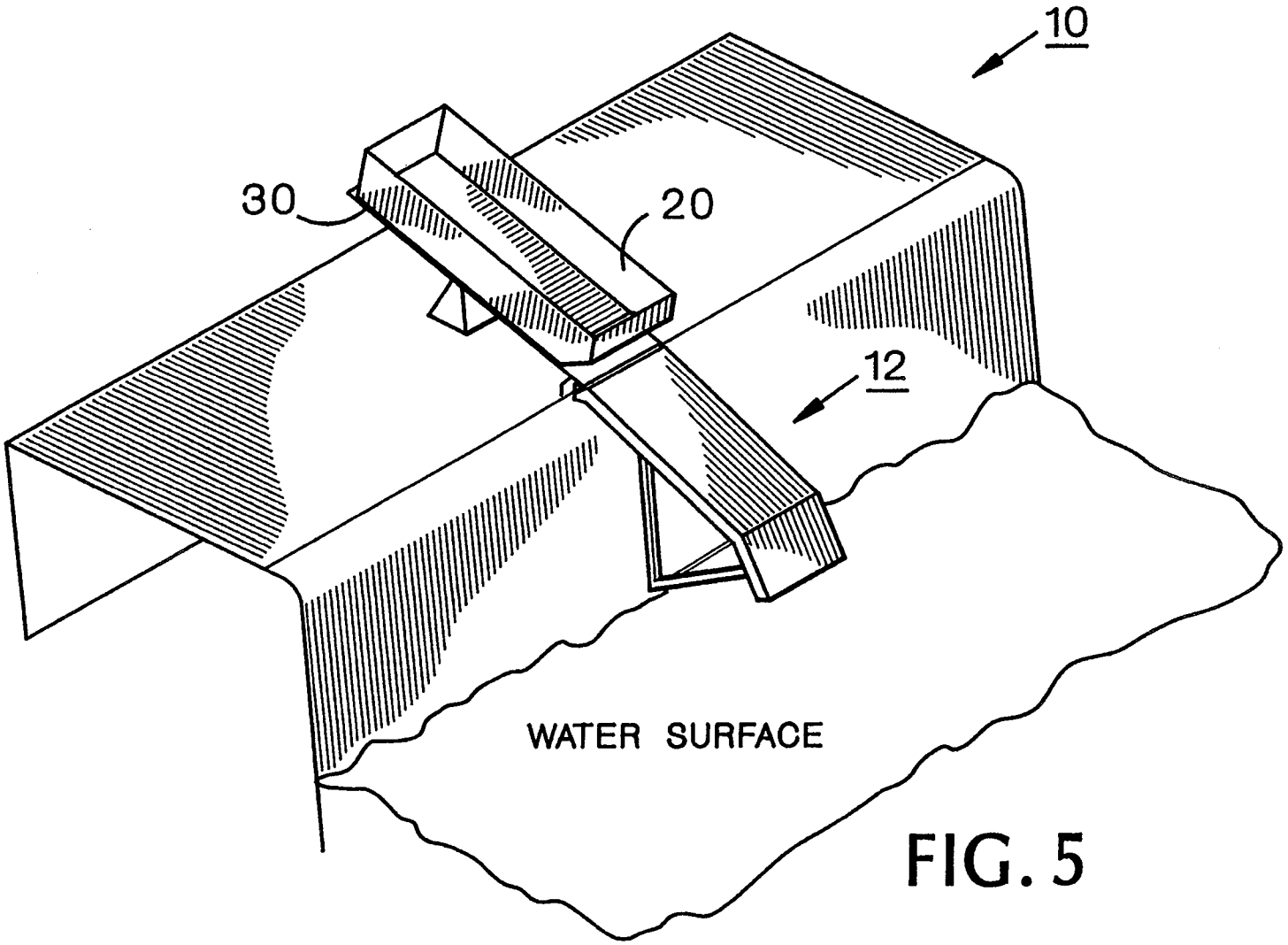
FIG. 5 is a fragmentary, perspective view of the first step of FIG. 4.

FIG. 4 schematically illustrates the initial steps in launching splash barge 20. Ship 10 includes starboard and port holds 36 and 38, respectively, separated by a centerline bulkhead 40. Starboard hold 36 has been filled with water 200 to give ship 10 a list to starboard, as shown. Additionally, tilt platform 30 has been rotated so that the inboard end thereof is above its outboard end, with the outboard end slightly overlapping the top of launching structure 12. This is also shown on FIG. 5.

Figure 6:
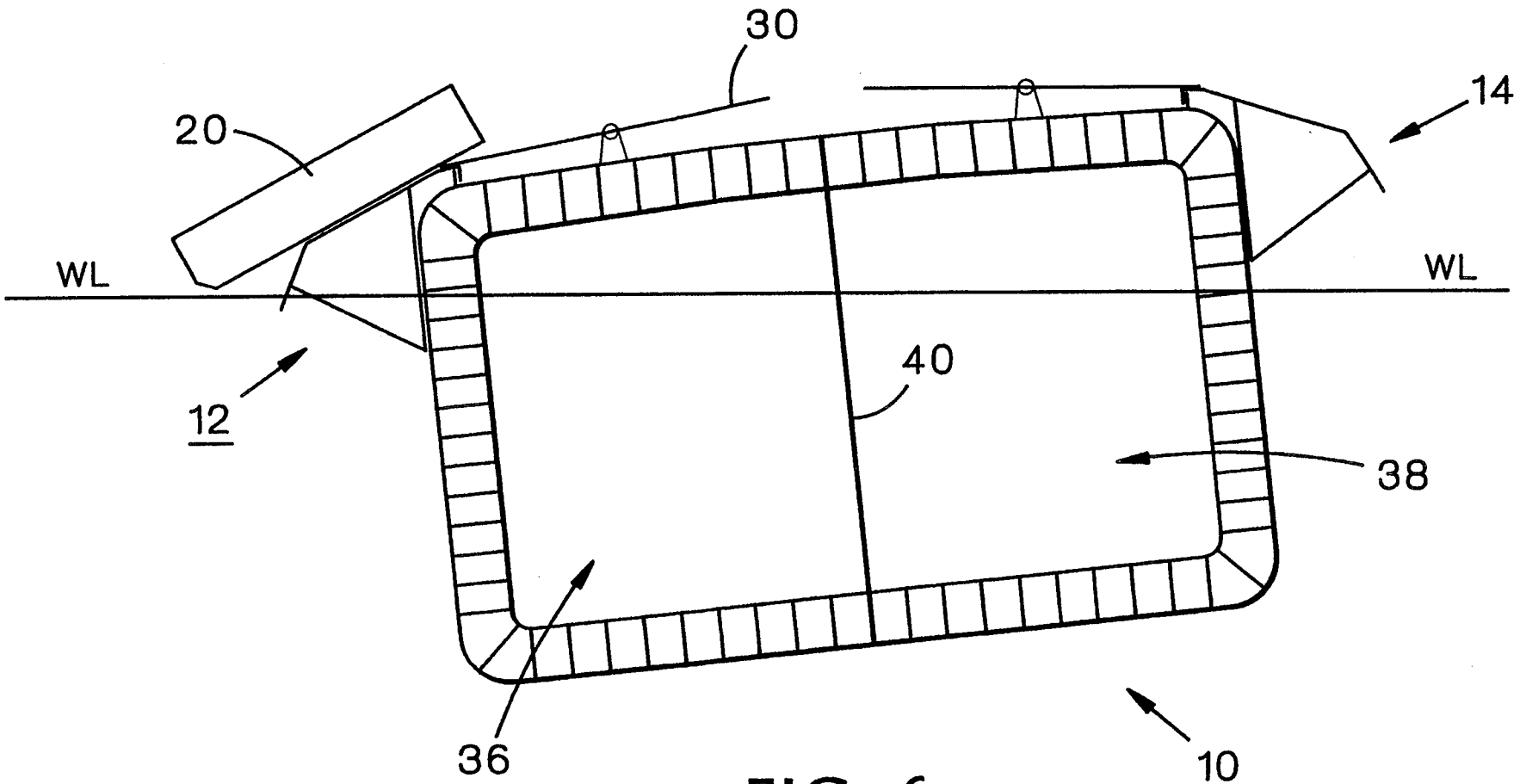
FIG. 6 is a schematic, end elevational view, partially in cross-section, showing the launching of the barge of FIG. 3.

On FIG. 6, it can be seen that gravity has caused splash barge 20 to slide down the upper surface of launching structure 12 toward the surface of the water. Splash barge 20 will continue to slide until it enters the water and drops off the end of launching structure 12.

Figure 7:
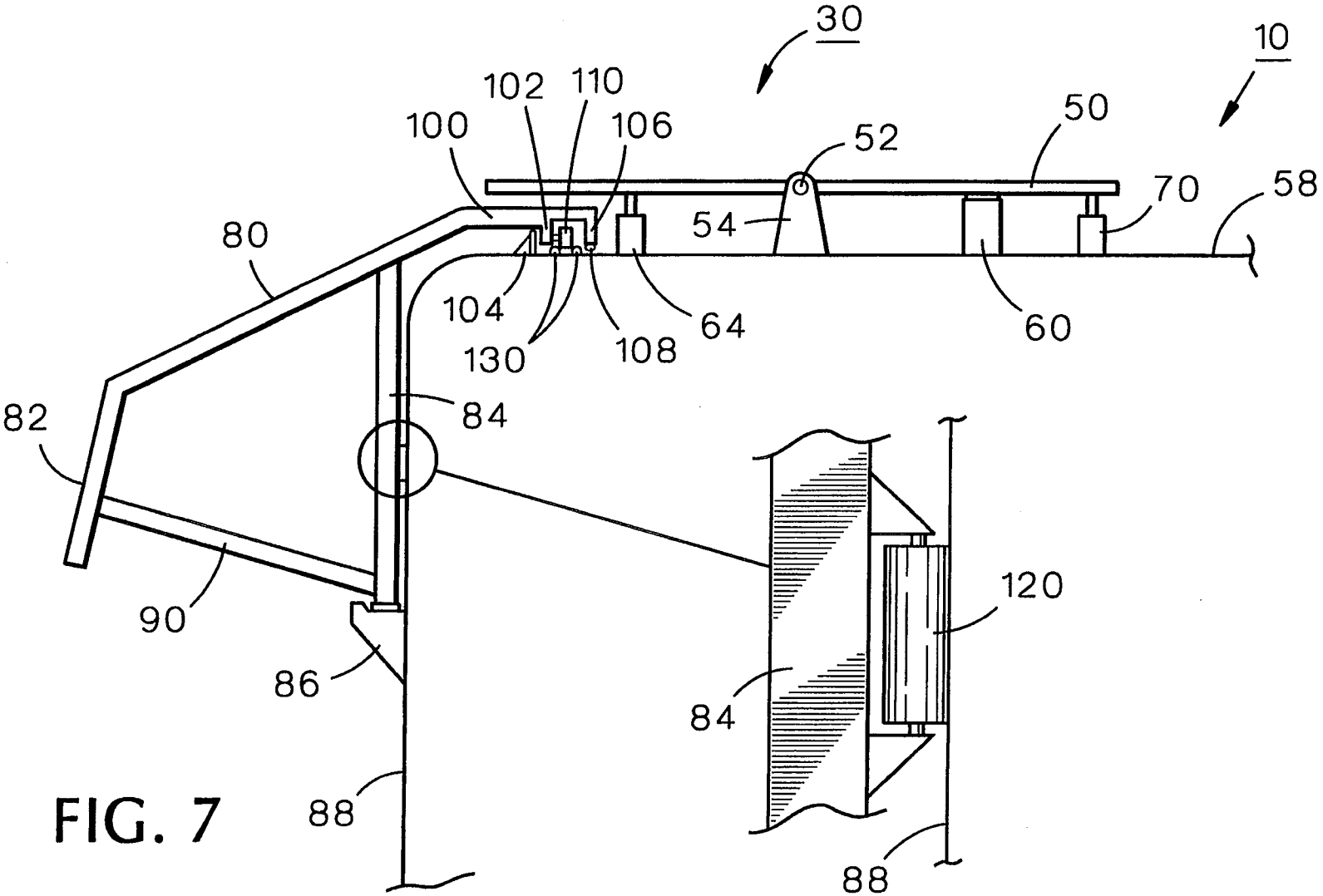
FIG. 7 is a side elevational view illustrating the launching mechanism of the present invention.
Figure 8:
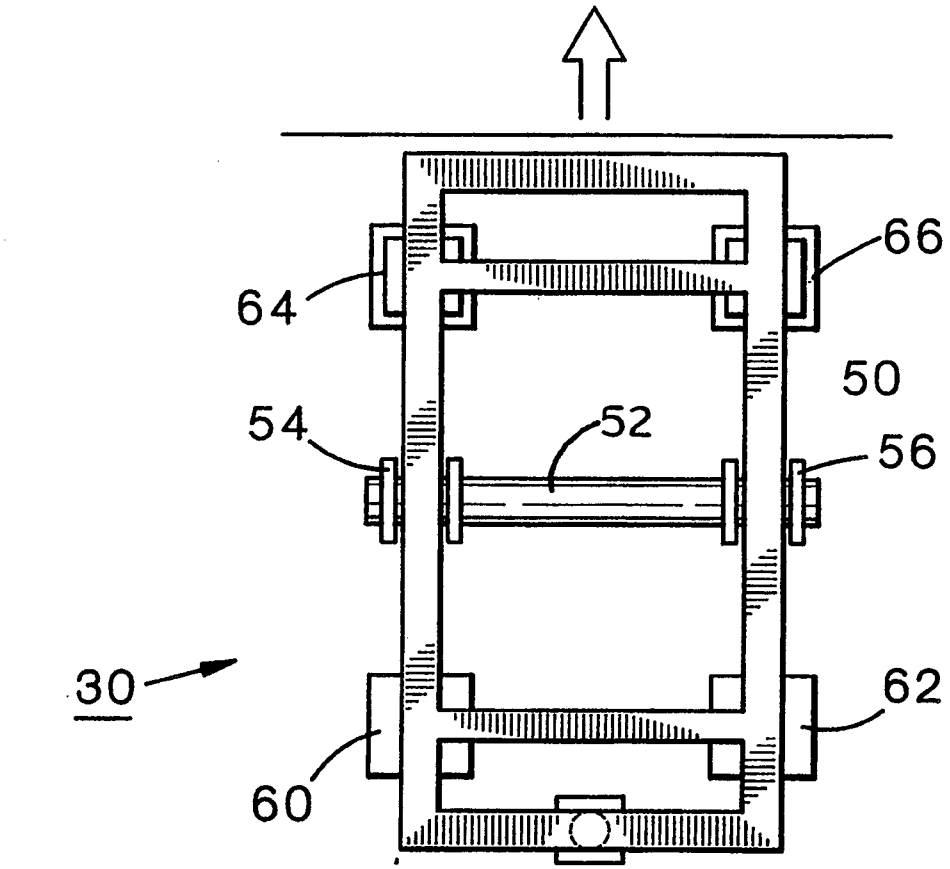
FIG. 8 is a top plan view of a tilt platform employed in the present invention.

Reference now to FIGS. 7 and 8 together will aid in understanding the details of the launching system of the present invention. Tilt platform 30 includes a horizontal frame member 50 rotatably mounted to a horizontal shaft 52 which is supported by stanchions 54 and 56 fixedly mounted to the main deck 58 of ship 10. Shaft 52 and stanchions 54 and 56 may comprise conventional "seesaw" type side launching gear.

Support blocks 60 and 62, which may be wood, fixedly mounted on deck 58 are disposed underneath frame 50 near the inboard end thereof to support frame 50 when it is in its stored position (FIGS. 3 and 6). Telescoping supports 64 and 66 fixedly mounted on deck 58 are disposed underneath frame 50 near the outboard end thereof to support, when the telescoping supports are extended, the frame when it is in its stored position. Supports 64 and 66 may be of the conventional "sand block" type. A hydraulic cylinder 70 fixedly mounted on deck 58 is disposed at the inboard end of frame 50 to cause the frame to rotate about shaft 52.

Launching structure 12 includes an upper inclined sliding surface 80 and a cojoined lower inclined sliding surface 82. A vertical frame member 84 extends between upper inclined surface 80 and a support bracket 86 fixedly mounted to the side of hull 88 of ship 10. A strut 90 extends between the lower end of vertical frame member 84 and the lower end of lower inclined surface 82.

A horizontal extension 100 at the upper end of upper inclined surface 80 had a first flange 102 extending vertically downwardly therefrom to engage a support bracket 104 and a second flange 106 extending vertically downwardly from the horizontal extension. At the end of second flange 106 is attached a chain 108 which extends the length of the main deck. An eccentric wheel 110 is attached to first flange 102. Chain 108 and eccentric wheel 110 may be arranged as conventionally employed in hatch cover maneuvering systems.

The lower end of vertical frame member 84 and the inside surface of support bracket 104 are faced with a high molecular weight, low friction polyethylene lining. A vertical side roller 120 attached to vertical frame member 84 is disposed between the vertical frame member and hull side 88.

Referring now primarily to FIG. 7, after launching structure 12 is deployed by crane 16 (FIG. 2), eccentric roller 110 is lowered to deck 58 (FIG. 7) which lifts the end of vertical frame member 84 from bracket 86. Launching structure 12 is then located to the desired fore and aft position on ship 10 (FIGS. 1 and 2) by means of chain 108, as the eccentric roller 110 rides in a groove defined between guide rails 130 fixedly attached to deck 58 and roller 120 rides along side hull 88. When launching structure 12 has reached its desired fore and aft position, eccentric roller 110 is raised and the launching structure is supported by support brackets 86 and 104. Now, telescoping supports 64 and 66 are lowered and hydraulic cylinder 70 is extended to raise the inboard end of frame 50 to cause a splash barge (not shown) on the platform to slide down upper inclined surface 80 and into the water as the lower edge of the stern of the barge slides down lower inclined surface 82. Referring to FIG. 6, the lower edge of the bow of splash barge 20 is undercut to minimize resistance as the barge enters the water.

Upper inclined surface 80 is preferably inclined from the horizontal on the order of about 20–30 degrees, while lower inclined surface 82 is preferably inclined from the horizontal on the order of about 60–70 degrees.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A system for launching barges from the deck of a ship, said barges being disposed in spaced apart relationship fore and aft along the deck of said ship, said system comprising:

(a) a track fixedly disposed fore and aft along said deck;

(b) ramp means slidable along said track and selectively positionable along the side of said ship such that a selected one of said barges may be placed on said ramp means and allowed to slide therealong by gravity into water in which said ship is floating; and (c) a tilt platform on which said selected barge is disposed prior to the launching thereof, said tilt platform and said ramp means being arranged such that said tilt platform is rotatable so as to cause said barge to slide onto said ramp means prior to said barge sliding into said water.

2. A system, as defined in claim 1, further comprising means to cause said ship to list to the side from which said barge is to be launched to assist said selected barge in sliding down said ramp means.

3. A system, as defined in claim 1, wherein said ramp means has a first inclined surface sloping downwardly from a first end at said deck to a second end near said water and a second inclined surface sloping downwardly from said second end.

4. A system, as defined in claim 3, wherein said first inclined surface is inclined at an angle of about 20 degrees with respect to said deck.

5. A system, as defined in claim 3, wherein said second inclined surface is inclined at an angle of about 40 degrees with respect to said first inclined surface.

6. A system, as defined in claim 1, wherein said ramp means further comprises:

(a) a vertical support member extending from an upper portion of said ramp means to releasably engage a first support bracket attached to and extending alongside said side of said ship;

(b) a horizontal portion extending partially over said deck with a vertical frame member attached to and extending downwardly therefrom;

(c) an eccentric roller rotatably attached to said vertical frame member, with the central axis of said eccentric roller orthogonal to the major axis of said ship, said eccentric roller engaging said track for movement therealong; and (d) a second support bracket attached to and extending along said deck near an edge thereof underneath said horizontal portion of said ramp means; such that, when said eccentric roller is in a raised position, said ramp means will be lowered and will be supported by the engagement of said vertical support member with said first support bracket and the engagement of said horizontal portion with said second support bracket, and, when said eccentric roller is in a lowered position, said vertical support member will disengage said first support bracket and said horizontal portion will disengage said second support bracket and said ramp means is moveable along said hull of said ship.

7. A system, as defined in claim 6, further comprising a moveable chain attached to said horizontal portion of said ramp means to move said ramp means along said hull of said ship.

8. A system, as defined in claim 6, further comprising a vertical roller rotatably attached to said vertical support member and disposed between said vertical support member and said side of said ship.

9. A method of launching barges from the deck of a ship, said barges being disposed in spaced apart relationship fore and aft along the deck of said ship, said method comprising:

(a) sliding ramp means along a track fixedly disposed fore and aft along said deck and selectively positioning said ramp means along the side of said ship adjacent a selected one of said barges;

(b) rotating a tilt platform on which said selected barge is disposed prior to the launching thereof to thereby place said selected one of said barges on said ramp means and allowing said selected one of said barges to slide therealong by gravity into water in which said ship is floating.

10. A method, as defined in claim 9, further comprising causing said ship to list to the side from which said barge is to be launched to assist said selected barge in sliding along said ramp means.

* * * * *